US010671000B2

(12) United States Patent
Kondo

(10) Patent No.: US 10,671,000 B2
(45) Date of Patent: Jun. 2, 2020

(54) FIXING DEVICE AND IMAGE FORMING APPARATUS INCLUDING THE SAME

(71) Applicant: KYOCERA Document Solutions Inc., Osaka (JP)

(72) Inventor: Akihiro Kondo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/574,192

(22) Filed: Sep. 18, 2019

(65) Prior Publication Data

US 2020/0089148 A1 Mar. 19, 2020

(30) Foreign Application Priority Data

Sep. 19, 2018 (JP) ..... 2018-174878

(51) Int. Cl.
*G03G 15/20* (2006.01)
*G03G 15/00* (2006.01)

(52) U.S. Cl.
CPC ..... *G03G 15/2042* (2013.01); *G03G 15/2064* (2013.01); *G03G 15/5016* (2013.01); *G03G 15/607* (2013.01); *G03G 2215/00734* (2013.01)

(58) Field of Classification Search
CPC ..... G03G 15/2042; G03G 15/2064; G03G 15/5016; G03G 15/607; G03G 2215/00734
See application file for complete search history.

(56) References Cited

U.S. PATENT DOCUMENTS

| | | | | |
|---|---|---|---|---|
| 10,180,645 | B1 * | 1/2019 | Kurosawa | G03G 15/2039 |
| 10,303,095 | B2 * | 5/2019 | Takagi | G03G 15/2039 |
| 2003/0185583 | A1 * | 10/2003 | Senda | G03G 15/2014 399/69 |
| 2005/0207774 | A1 * | 9/2005 | Sone | G03G 15/2042 399/69 |
| 2006/0099001 | A1 * | 5/2006 | Asakura | G03G 15/2042 399/69 |
| 2007/0019063 | A1 * | 1/2007 | Yasuda | G03G 15/2042 347/223 |
| 2008/0002996 | A1 * | 1/2008 | Ushiro | G03G 15/2064 399/31 |
| 2008/0240748 | A1 * | 10/2008 | Kinouchi | G03G 15/2039 399/33 |
| 2009/0202266 | A1 * | 8/2009 | Kurata | G03G 15/2042 399/69 |

(Continued)

FOREIGN PATENT DOCUMENTS

| | | | |
|---|---|---|---|
| JP | 2000227732 A | * | 8/2000 |
| JP | 2007-3797 | | 1/2007 |

*Primary Examiner* — David J Bolduc
(74) *Attorney, Agent, or Firm* — Wenderoth, Lind & Ponack, L.L.P.

(57) ABSTRACT

A fixing device includes a sensor driving unit that drives a temperature sensor to be movable in an axial direction of a fixing rotating body, and a sensor position control unit that controls the position of the temperature sensor by the sensor driving unit. The sensor position control unit performs sensor position control for setting a sheet size identified by a size identification unit as a reference sheet size and allowing the temperature sensor to be located within a passage area of a sheet having the reference sheet size and a non-passage area of a sheet having a sheet size smaller by one size than the reference sheet size.

4 Claims, 15 Drawing Sheets

(56) References Cited

U.S. PATENT DOCUMENTS

| | | | | |
|---|---|---|---|---|
| 2013/0034362 | A1* | 2/2013 | Matsuura | G03G 15/2042 399/69 |
| 2013/0058673 | A1* | 3/2013 | Kikkawa | G03G 15/2042 399/69 |
| 2013/0142533 | A1* | 6/2013 | Shimizu | G03G 15/2046 399/67 |
| 2016/0116869 | A1* | 4/2016 | Saito | G03G 15/2042 399/69 |
| 2017/0090364 | A1* | 3/2017 | Yotsutsuji | G03G 15/2064 |
| 2018/0217541 | A1* | 8/2018 | Nomura | G03G 15/2042 |

* cited by examiner

FIXING DEVICE AND IMAGE FORMING APPARATUS INCLUDING THE SAME

CROSS-REFERENCE TO RELATED APPLICATION

This application is based upon and claims the benefit of priority from Japanese Patent Application No. 2018-174878 filed on Sep. 19, 2018, the entire contents of which are incorporated herein by reference.

BACKGROUND

The technology of the present disclosure relates to a fixing device and an image forming apparatus including the same.

An electrophotographic image forming apparatus includes a fixing device that fixes a toner image, which has been transferred to a sheet, to the sheet.

The fixing device includes a fixing roller having a heating device in a rotatable cylindrical part and a pressure roller brought into press-contact with the fixing roller to form a nip part. When a sheet (a paper, an OHP and the like) with a toner image formed thereon passes through between the fixing roller and the pressure roller, the toner image is heated and pressurized and is fixed to the sheet at that time.

As the heating device, there has been proposed a device including a central heater that mainly heats an axial center part of the fixing roller and an end heater that mainly heats an axial end part of the fixing roller. In the vicinity of the surface of the fixing roller, temperature detection sensors are fixedly disposed at the axial center part and end part, respectively. In the heating device, the heaters are controlled based on temperatures detected by the temperature detection sensors such that the temperature of both end parts of the fixing roller is higher than that of an intermediate part thereof. In this way, a reverse crown shape can be imparted to the sheet to prevent wrinkles from occurring.

As described above, in the heating device including the central heater and the end heater, heating ratio control is generally performed to change a heating ratio between the central heater and the end heater according to a width size of the sheet. In a non-passage area (that is, an area outside the width direction of a sheet passage area) of a sheet in the fixing roller, since heat is not lost to the sheet, excessive temperature rise is likely to occur. In this regard, it has been proposed to perform the heating ratio control in order to prevent the excessive temperature rise.

FIG. 16 is a graph illustrating the heat distribution of the central heater and the heat distribution of the end heater in the related fixing device in which the heating ratio control is performed. The central heater is set to have a large heat distribution (heat generation amount) at the center of the fixing roller and the end heater is set to have a large heat distribution (heat generation amount) at the end part of the fixing roller.

Furthermore, in the heating ratio control, for example, the lighting ratio of the end heater is lowered as the width size of the sheet is smaller. FIG. 17 is a graph illustrating the temperature distribution on the surface of the fixing roller when the heating ratio control is performed. It can be seen that the temperature of the non-passage area of the sheet on the surface of the fixing roller is suppressed to a threshold temperature or less when any of A4 to A6 size sheets is used (excessive temperature rise is prevented).

SUMMARY

A fixing device according to one aspect of the present disclosure includes a fixing rotating body, a heating unit, a pressure rotating body, a size identification unit, a temperature sensor, a heating control unit, a sensor driving unit, and a sensor position control unit.

The heating unit heats the fixing rotating body. The pressure rotating body is brought into press-contact with the fixing rotating body to form a nip part through which a sheet passes. The size identification unit detects manual operation related to a sheet size of a sheet to be used and identifies the sheet size of the sheet to be used from a plurality of predetermined fixed sizes. The temperature sensor detects the surface temperature of the fixing rotating body. The heating control unit controls the heating unit such that the temperature detected by the temperature sensor reaches a target temperature and reduces a heating ratio on an end part side in an axial direction of the fixing rotating body by the heating unit as compared with a center side as the sheet size identified by the size identification unit is smaller. The sensor driving unit drives the temperature sensor to be movable in the axial direction of the fixing rotating body. The sensor position control unit controls the position of the temperature sensor by the sensor driving unit. The sensor position control unit is configured to perform sensor position control for setting the sheet size identified by the size identification unit as a reference sheet size and allowing the temperature sensor to be located within a passage area of a sheet having the reference sheet size and a non-passage area of a sheet having a sheet size smaller by one size than the reference sheet size.

DETAILED DESCRIPTION

Hereinafter, an embodiment will be described in detail on the basis of the drawings. It is noted that the technology of the present disclosure is not limited to the following embodiments.

Embodiment

Figure 1:
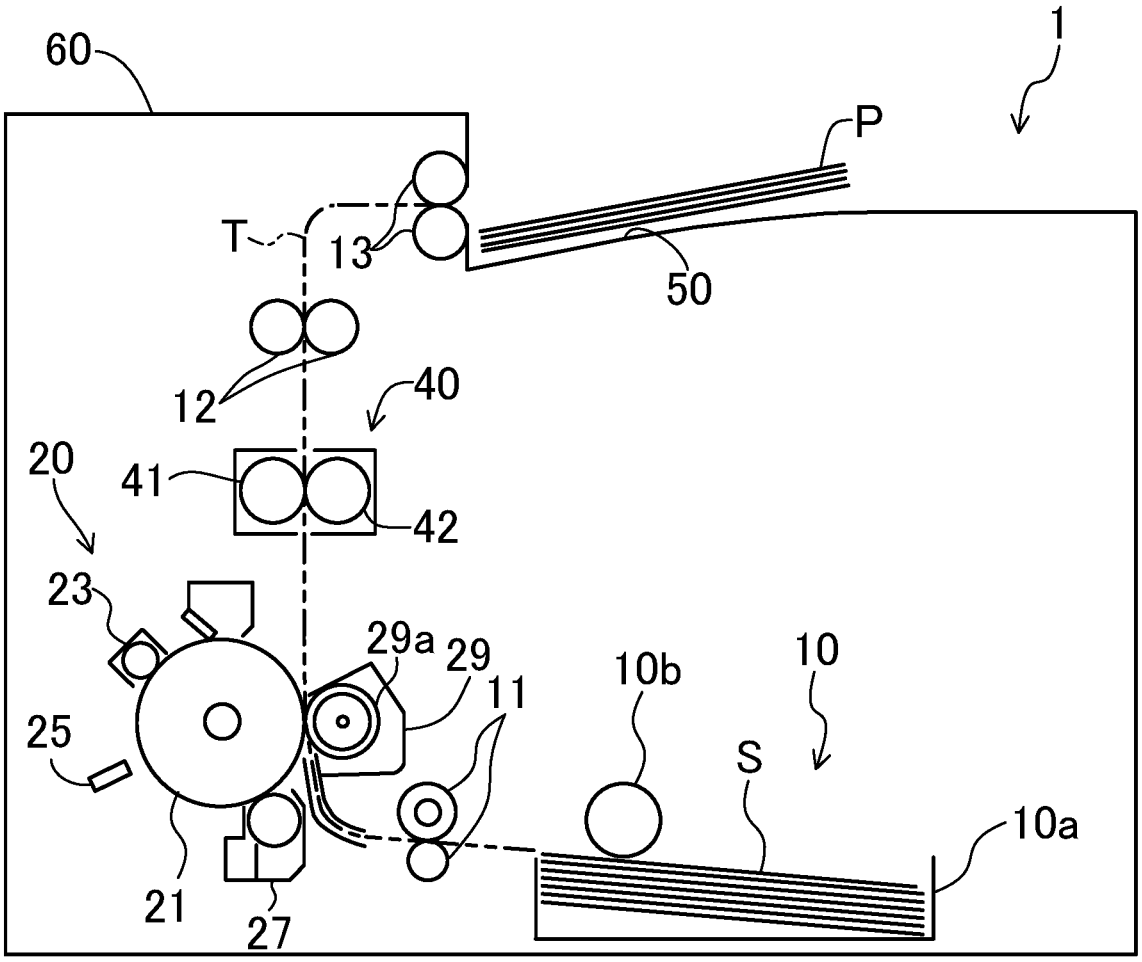
FIG. 1 is a schematic view illustrating an image forming apparatus including a fixing device in an embodiment.

FIG. 1 illustrates an image forming apparatus 1 in the present embodiment. In the present embodiment, the image forming apparatus 1 is a monochrome laser printer.

The image forming apparatus 1 has a sheet feeding unit 10, an image generation unit 20, a fixing device 40, a sheet discharge unit 50, and a casing 60. On a sheet conveyance path T from the sheet feeding unit 10 to the sheet discharge unit 50, a plurality of conveying roller pairs 11 to 13 are disposed to convey a sheet S while interposing the sheet S therebetween.

The sheet feeding unit 10 is disposed at a lower part inside the casing 60. The sheet feeding unit 10 has a sheet feeding cassette 10*a* that stores the sheet-shaped sheet S (for example, a recording sheet, an OHP sheet and the like), and a pick-up roller 10*b* that takes out the sheet S in the sheet feeding cassette 10*a* and sends the taken-out sheet S out of the cassette. The sheet S sent out of the cassette by the sheet feeding cassette 10*a* is supplied to the image generation unit 20 via the conveying roller pair 11.

The image generation unit 20 has a photosensitive drum 21, a charging device 23, an exposing device 25, a developing device 27, a transfer device 29, and a toner container (not illustrated). In the image generation unit 20, a peripheral surface of the photosensitive drum 21 is charged by the charging device 23, and then laser light based on document image data (for example, image data of a document image received from an external terminal) is irradiated to the surface of the photosensitive drum 21 by the exposing device 25, so that an electrostatic latent image is formed. The electrostatic latent image formed (carried) on the surface of the photosensitive drum 21 is developed as a toner image by toner supplied from the developing device 27. The toner image developed by the developing device 27 is transferred to the sheet S, which is supplied from the sheet feeding unit 10, by the transfer device 29. The sheet S after the transfer is supplied to the fixing device 40 by a transfer roller 29*a* of the transfer device 29 and the photosensitive drum 21.

The fixing device 40 pressurizes and heats the sheet S supplied from the image generation unit 20 between a fixing roller 41 (fixing rotating body) and a pressure roller 42 (pressure rotating body), thereby fixing the toner image to the sheet S.

Then, the sheet S with the toner image fixed by the fixing device 40 is sent to a downstream side with the rotation of the fixing roller 41 and the pressure roller 42. The sent sheet S is discharged to the sheet discharge unit 50 formed on an upper surface of the casing 60 by the conveying roller pairs 12 and 13.

[Configuration of Fixing Device 40]

Figure 2:
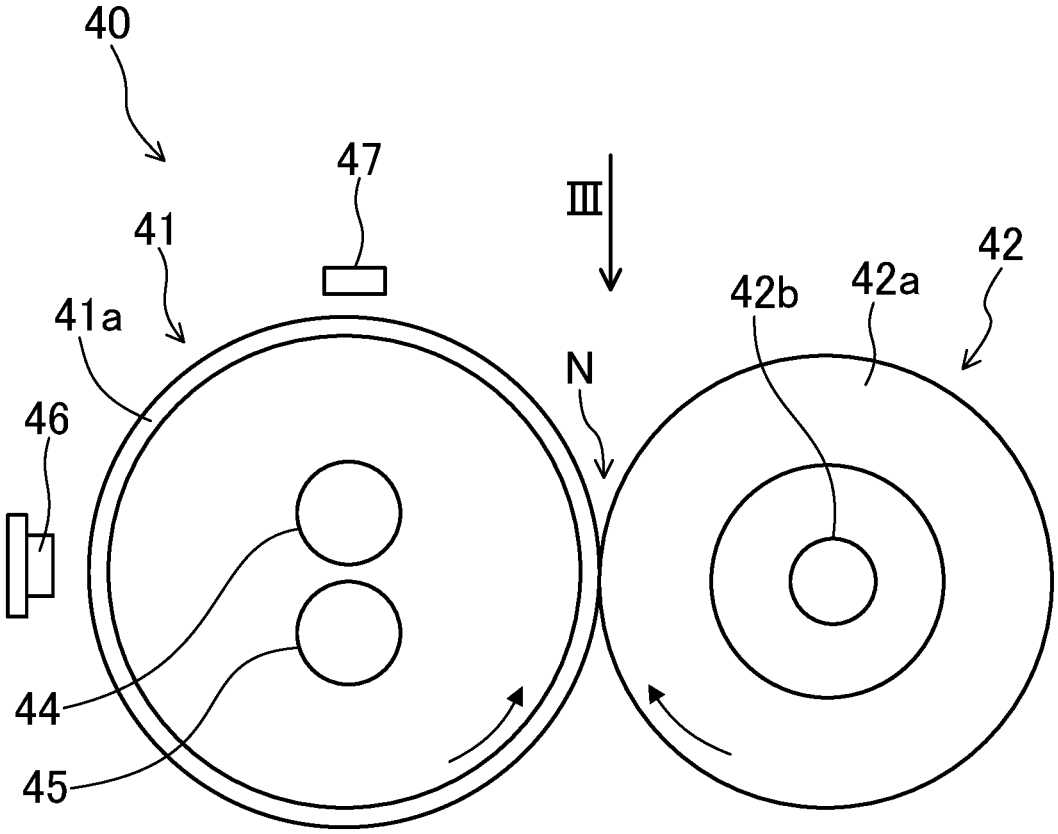
FIG. 2 is a schematic view when a fixing device is viewed from an axial direction.
Figure 3:
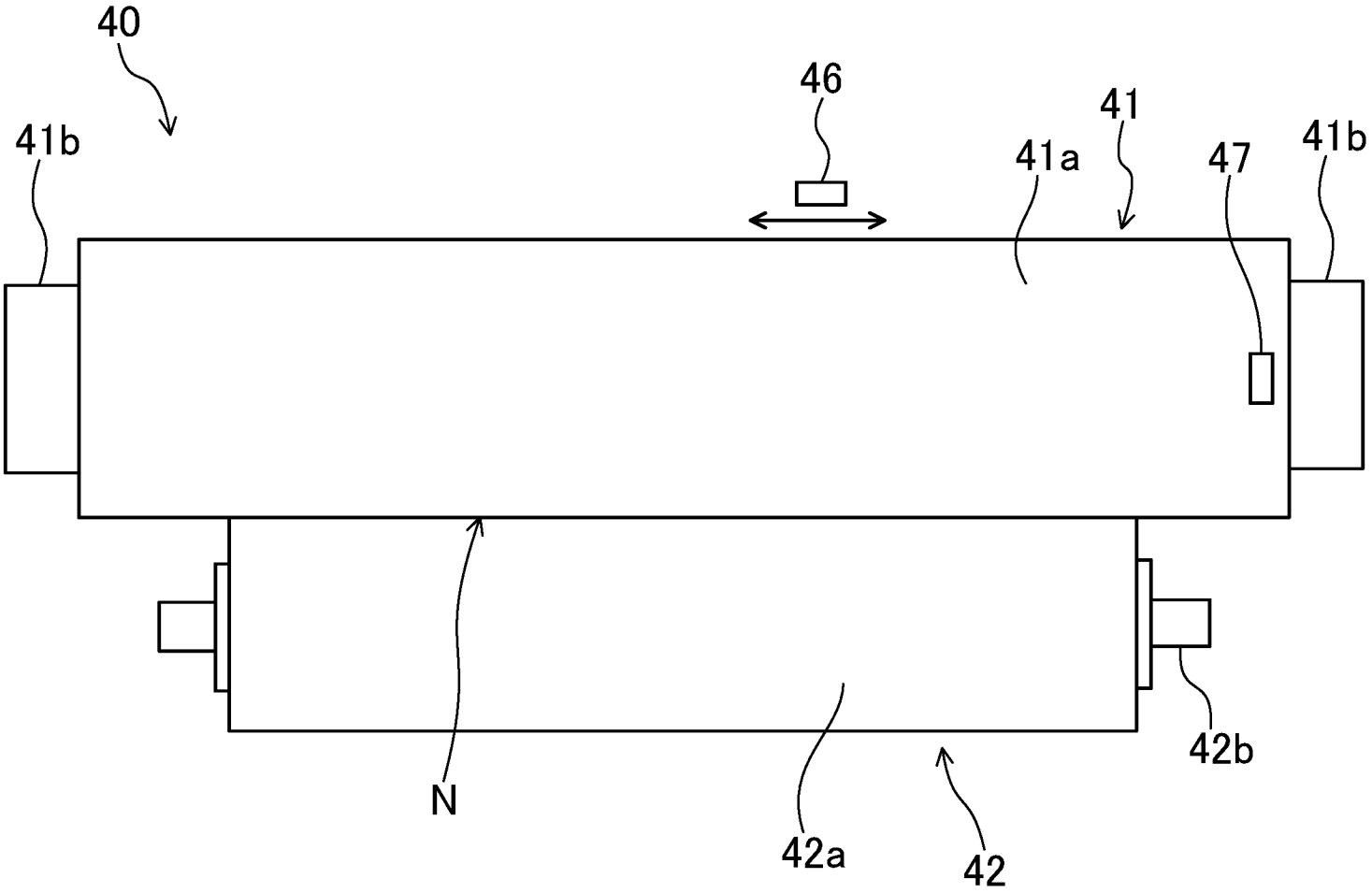
FIG. 3 is a view in the direction of the arrow III of FIG. 2.

As illustrated in FIG. 2 and FIG. 3, the fixing roller 41 of the fixing device 40 has a cylindrical roller body 41*a*. An outer peripheral surface of the roller body 41*a* comes into contact with a printing surface (surface on which toner is carried) of the sheet S. The roller body 41*a* is made of a material having a high thermal conductivity such as aluminum, for example. The outer peripheral surface of the roller body 41*a* is subjected to PFA coating serving as a surface release layer.

A support shaft 41*b* constituting a rotating shaft is attached to both axial end parts of the roller body 41*a*. The support shaft 41*b* is rotatably supported to a bearing part of a casing frame 43. The fixing roller 41 is rotationally driven in a counterclockwise direction of FIG. 2 around the support shaft 41*b* by a motor (not illustrated).

In an inner space of the roller body 41*a*, a main heater and a sub-heater 45 are disposed to extend in the axial direction. The main heater 44 and the sub-heater 45 are constituted by, for example, halogen heaters, respectively. The main heater 44 and the sub-heater 45 correspond to a heating unit. It is noted that each of the heaters 44 and 45 is not limited to the halogen heater and may be constituted by for example, a ceramic heater, an IH heater and the like.

The main heater 44 and the sub-heater 45 are provided over the entire axial direction of the roller body 41*a*. The main heater 44 mainly heats the intermediate part inside the roller body 41*a* rather than both axial end parts of the roller body 41*a*. The sub-heater 45 mainly heats both axial end parts of the roller body 41*a*. The main heater 44 and the sub-heater 45 are controlled by a control unit 100 to be described below.

The pressure roller 42 is disposed to face the fixing roller 41 in a radial direction. The pressure roller 42 extends in parallel with the fixing roller 41. The pressure roller 42 is brought into press-contact with the fixing roller by an elastic member such as a spring. A contact part between the pressure roller 42 and the fixing roller 41 constitutes a nip part N through which the sheet S passes during a fixing process.

The pressure roller 42 has a cylindrical roller body 42*a*. The roller body 42*a* is composed of, for example, an iron core bar, a silicon rubber layer that is an elastic layer, and a PFA tube that is a surface release layer. A support shaft 42*b* constituting a rotating shaft is attached to both axial end parts of the roller body 42*a*. The support shaft 42*b* is rotatably supported to the bearing part of the casing frame 43. The pressure roller 42 rotates about the support shaft 42*b* in accordance with the rotation of the fixing roller 41.

During the fixing process of the fixing device 40, the fixing roller 41 and the pressure roller 42 rotate in the direction of the arrow of FIG. 2. Accordingly, the sheet S is conveyed to pass through the nip part N from the lower side to the upper side. During this passage, the toner image on the printing surface of the sheet S is molten by heat from the fixing roller 41 and is pressurized against the sheet S by pressure between the rollers 41 and 42. In this way, the toner image is fixed to the sheet S.

[Arrangement Configuration of Main Temperature Sensor 46 and Sub-Temperature Sensor 47]

As illustrated in FIG. 2 and FIG. 3, the main temperature sensor 46 and the sub-temperature sensor 47 are provided around the fixing roller 41. Each of the temperature sensors 46 and 47 is used for detecting the surface temperature of the fixing roller 41. Each of the temperature sensors 46 and 47 includes a non-contact type thermistor, for example. Each of the temperature sensors 46 and 47 is disposed such that a temperature detection part faces the outer peripheral surface of the fixing roller 41. It is noted that the thermistor is not necessarily employed as the temperature sensors 46 and 47 and for example, it may be possible to employ a thermopile that measures temperature by measuring infrared rays emitted from an object. Furthermore, each of the temperature sensors 46 and 47 is not limited to the non-contact type and may be a contact type in which the temperature detection part comes into contact with the outer peripheral surface of the fixing roller 41.

The main temperature sensor 46 mainly measures the temperature of the axial intermediate part (inner side than both end parts) of the fixing roller 41. The main temperature sensor 46 is provided on an opposite side of the nip part N by 180° while interposing a shaft center of the fixing roller 41 therebetween (see FIG. 2). The main temperature sensor 46 is configured to be movable in the axial direction of the fixing roller 41 (see FIG. 3). The axial position of the main temperature sensor 46 is changed according to a sheet size set by a user through an operation unit 1*a* as will be described below. The main temperature sensor 46 transmits information on the detected temperature to the control unit 100 to be described below.

The sub-temperature sensor 47 detects the surface temperature of the axial end part (for example, outside in the axial direction from a sheet A4 of a maximum size) of the fixing roller 41. The sub-temperature sensor 47 is fixed to a bracket part (not illustrated) in the casing frame 43, unlike the main temperature sensor 46. The sub-temperature sensor 47 is provided at a position away from the main temperature sensor 46 by 90° on the rotation upstream side when viewed from the axial center direction of the fixing roller 41 (see FIG. 2). The sub-temperature sensor 47 is disposed such that the temperature detection part faces the surface of the end part of the fixing roller 41 (see FIG. 3). The sub-temperature sensor 47 transmits information on the detected temperature to the control unit 100 to be described below.

[Configuration of Control System]

Figure 4:
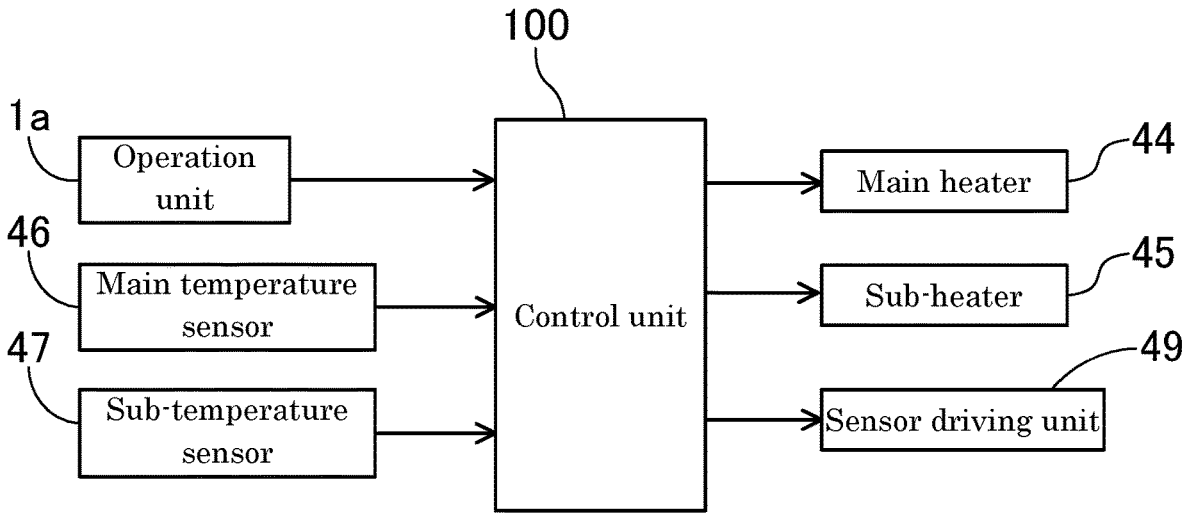
FIG. 4 is a block diagram illustrating a configuration of a control system related to heating control of a fixing roller.

Next, with reference to FIG. 4, the configuration of the control system related to the heating control by the main heater 44 and the sub-heater 45 will be described. The control system includes the control unit 100 that controls various devices including the fixing device 40.

The control unit 100 is constituted by a microcomputer having a CPU, a ROM, and a RAM, and is provided in the casing of the image forming apparatus 1. The control unit 100 serves as a size identification unit, a sensor position control unit, and a heating control unit.

The control unit 100 is connected to the operation unit 1*a*, the main temperature sensor 46, and the sub-temperature sensor 47 via signal lines. The control unit 100 controls the main heater 44, the sub-heater 45, and a sensor driving unit 49 based on signals received from these devices.

The operation unit 1*a* is provided on an operation panel provided on the front side surface of the image forming apparatus 1. The operation unit 1*a* is constituted by a liquid crystal touch panel, for example, operable by a user's finger or a push-type push button device. A user can set the sheet size of the sheet S to be used by operating the operation unit 1*a*. The operation unit 1*a* transmits operation information by the user to the control unit 100. Based on the operation information received from the operation unit 1*a*, the control unit 100 identifies the sheet size set by the user.

The sensor driving unit 49 has an actuator for driving the main temperature sensor 46 in the axial direction of the fixing roller 41. The actuator is constituted by, for example, a motor and is connected to a linear motion mechanism (for example, a ball screw mechanism and the like) that linearly drives the main temperature sensor 46. The actuator is not limited to a motor and for example, may also be constituted by a direct acting electromagnetic solenoid.

The control unit 100 controls the axial position of the main temperature sensor 46 by a sensor driving unit 39 according to the sheet size to be used identified based on the signal from the operation unit 1*a*. Details of the position control of the main temperature sensor 46 by the control unit 100 will be described below.

[Operation Control of Main Heater 44 and Sub-Heater 45]

The control unit 100 performs the operation control of the main heater 44 and the sub-heater 45 such that the temperature detected by the main temperature sensor 46 reaches a target temperature (for example, 180° C. in the present embodiment).

Hereinafter, prior to the description of the operation control of the main heater 44 and the sub-heater 45, the heat distribution (heat generation amount distribution) in the axial direction of the heaters 44 and 45 will be described with reference to FIG. 5. In the graph, the vertical axis denotes a heat generation amount as a percentage and the horizontal axis denotes the axial position of the fixing roller 41.

As indicated by the graph, the heat generation amount of the main heater 44 is a maximum heat generation amount (=100%) at the axial intermediate part (passage area of an A6 size which is a minimum size) of the fixing roller 41 and is reduced to about 20% of the maximum heat generation amount at both axial end parts thereof.

Figure 5:
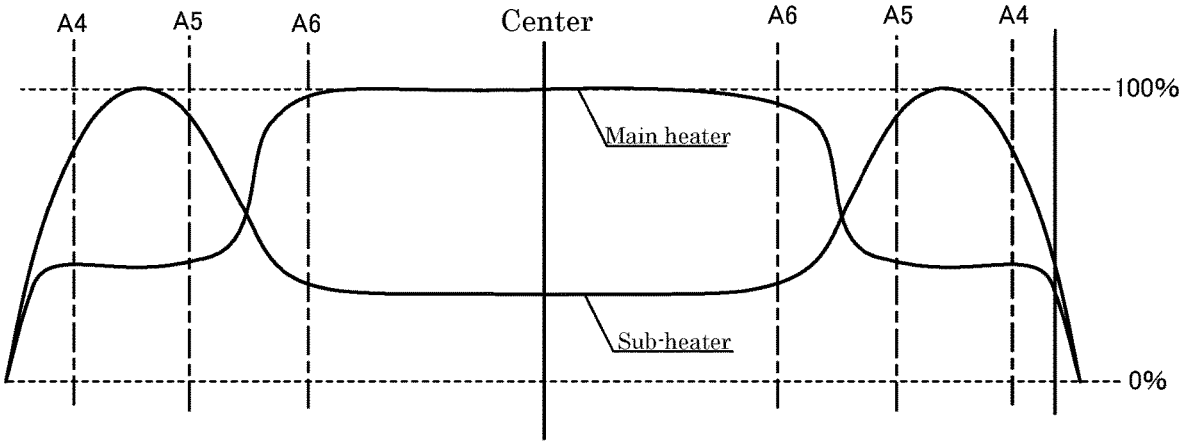
FIG. 5 is a graph illustrating a heat distribution of a main heater and a heat distribution of a sub-heater.

On the other hand, the heat generation amount of the sub-heater 45 is a maximum heat generation amount (=100%) at both axial end parts (between an outer end edge of an A4 size and an outer end edge of an A6 size in FIG. 5) of the fixing roller 41 and is reduced to about 20% of the maximum heat generation amount at the axial intermediate part (the passage area of the A6 size which is the minimum size) thereof.

As described above, the main heater 44 is configured such that the heat distribution increases at the axial center part of the fixing roller 41, and the sub-heater 45 is configured such that the heat distribution increases at both axial end parts of the fixing roller 41.

The control unit 100 is configured to reduce the lighting ratio of the sub-heater 45 (lighting ratio of the sub-heater with respect to the main heater 44) with a higher heat distribution (heat generation amount) on the end part side thereof as the sheet size (sheet width size) set by a user through the operation unit 1*a* is smaller. In this way, excessive temperature rise in the non-passage area (area on the end part side) of the sheet S in the fixing roller 41 is prevented.

Specifically, the control unit 100 sets the lighting ratio of the main heater 44 and the sub-heater 45 to 50:50 when the sheet size identified based on the signal from the operation unit 1*a* is the A4 size, sets the lighting ratio of the main heater 44 and the sub-heater 45 to 80:20 when the identified sheet size is the A5 size, and sets the lighting ratio of the main heater 44 and the sub-heater 45 to 100:0 when the identified sheet size is the A6 size. It is noted that the lighting ratio is a ratio of the operation times of the main heater 44 and the sub-heater 45 and is not limited to the values disclosed herein.

Furthermore, the control unit 100 detects the temperature at an axial one end pat of the fixing roller 41 by the sub-temperature sensor 47 and performs predetermined control such that the detected temperature does not exceed a threshold temperature (for example, 210° C. in the present embodiment). As the predetermined control, for example, control such as reducing the number of printed sheets per unit time (productivity) while stopping heating by the sub-heater 45 is conceived.

Figure 6:
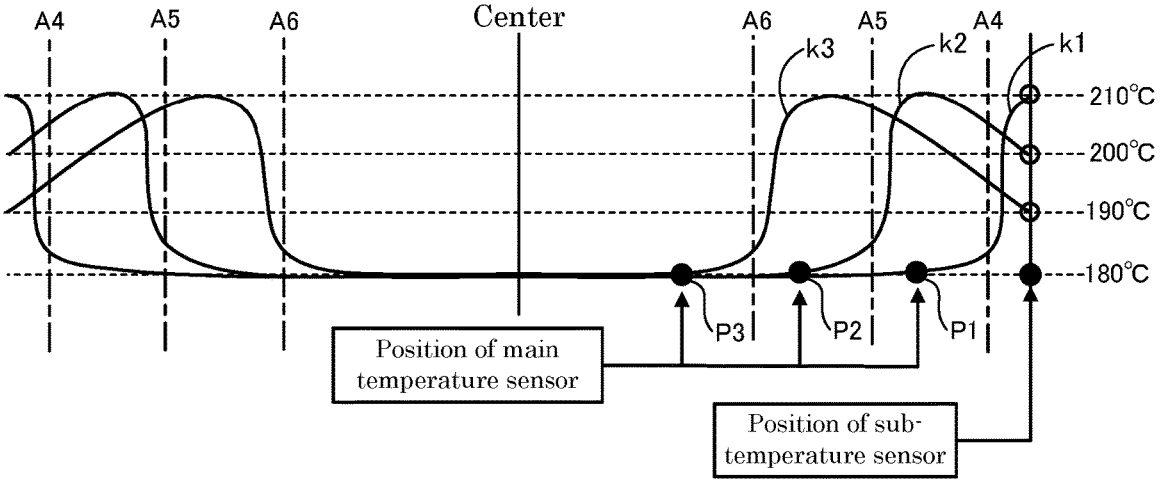
FIG. 6 is a graph for explaining a temperature distribution on a surface of a fixing roller and an axial position of a main temperature sensor when a sheet size set by an operation unit is an A4 size, an A5 size, or an A6 size.

FIG. 6 is a graph illustrating a temperature distribution on the surface of the fixing roller 41 in the axial direction when the aforementioned heating ratio control of the main heater 44 and the sub-heater 45 is performed. The vertical axis denotes temperature (° C.) and the horizontal axis denotes the axial position of the fixing roller 41. In the drawing, dashed lines extending vertically indicate the passing positions of both side end edges of each of the A4, A5, and A6 sizes in the width direction. It is noted that the description of the vertical axis, the horizontal axis, and the dashed lines extending vertically is also similar in FIG. 8 to FIG. 13 to be described below.

In FIG. 6, the line k1 indicates a case where the sheet size set through the operation unit 1*a* is A4, the line k2 indicates a case where the sheet size set through the operation unit 1*a* is A5, and the line k3 indicates a case where the sheet size set through the operation unit 1*a* is A6. In any case, the surface temperature of the fixing roller 41 is controlled to 180° C. (=target temperature) in the passage area of the sheet S and is controlled to 180° C. or more and 210° C. or less outside the passage area of the sheet S (non-passage area).

[Position Control of Main Temperature Sensor 46]

Next, the position control of the main temperature sensor 46 by the control unit 100 will be described. In the position control, the control unit 100 first identifies a sheet size set by a user based on the signal from the operation unit 1*a*.

Then, when the identified sheet size is not the minimum size (A4 size or A5 size in the present embodiment), the control unit 100 allows the main temperature sensor 46 to be located within the passage area of the sheet S having the identified sheet size (reference sheet size) and the non-passage area of the sheet S having a sheet size smaller by one size than the identified sheet size.

On the other hand, when the identified sheet size is the minimum size (A6 size in the present embodiment), the control unit 100 allows the main temperature sensor 46 to be located within the passage area of the sheet S having the minimum size and in the vicinity of the end part of the sheet S in the width direction.

In FIG. 6, reference numerals P1 to P3 indicate the positions of the main temperature sensor 46 which are changed according to the sheet size. The rightmost position P1 is the position of the main temperature sensor 46 when the A4 size is set through the operation unit 1*a*, the center position P2 is the position of the main temperature sensor 46 when the A5 size is set through the operation unit 1*a*, and the leftmost position P3 is the position of the main temperature sensor 46 when the A6 size is set through the operation unit 1*a*.

In the example of FIG. 6, the position P1 is located at the center between the outer end edge of the sheet S having the A4 size and the outer end edge of the sheet S having the A5 size. The position P2 is located at the center between the outer end edge of the sheet S having the A6 size and the outer end edge of the sheet S having the A5 size. The position P3 is located near the inner side of the outer end edge of the sheet S having the A6 size.

[Description of Flowchart]

Figure 7:
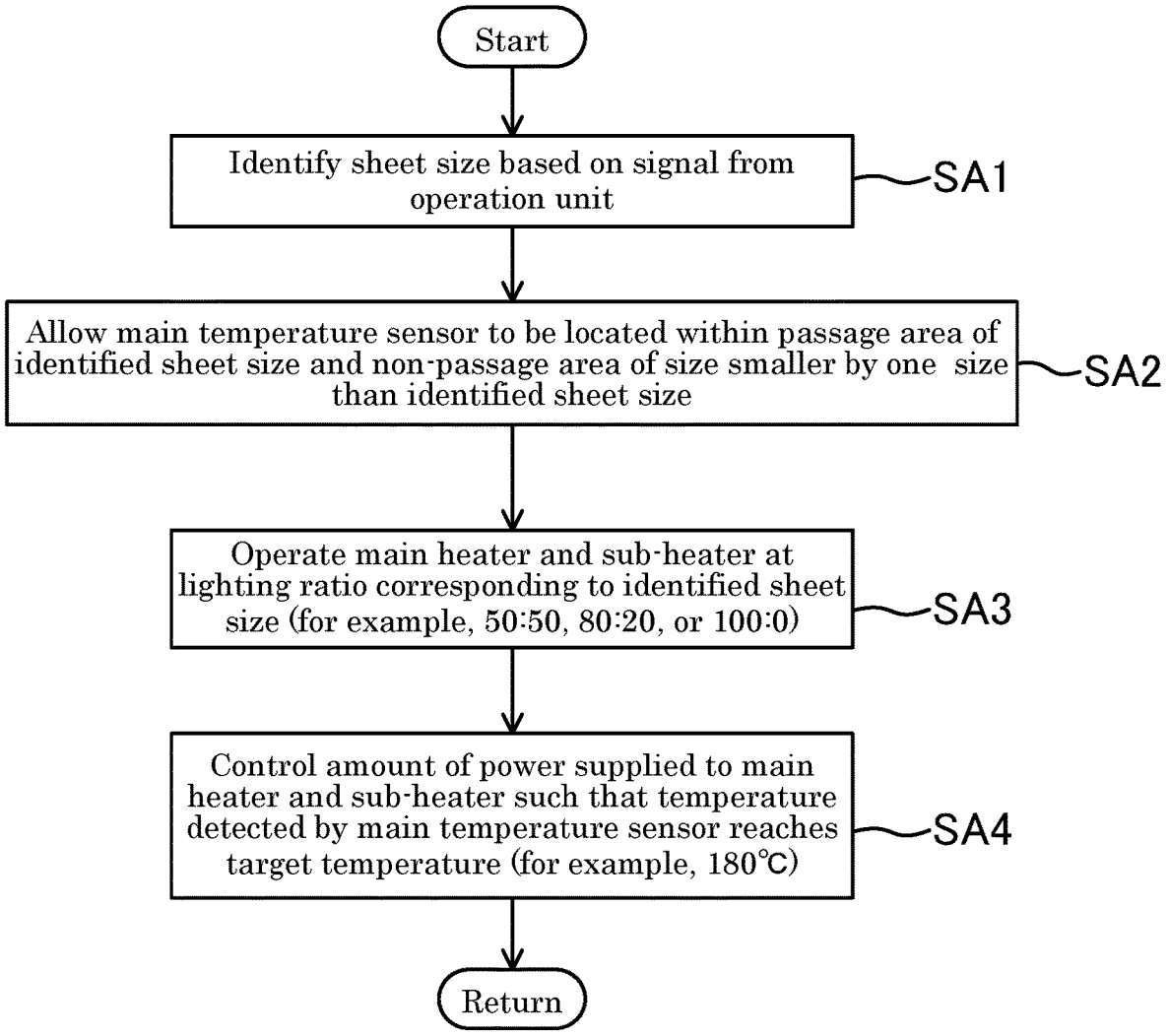
FIG. 7 is a flowchart illustrating control content in a control unit.

FIG. 7 is a flowchart illustrating the content of the operation control of the heaters 44 and 45 and the position control of the main temperature sensor 46 by the control unit 100.

In step SA1, the control unit 100 identifies a sheet size (sheet size of a sheet to be used) set by a user from a plurality of predetermined sizes (three of the A4, A5, and A6 sizes in the present embodiment) based on the signal from the operation unit 1*a*.

In step SA2, the control unit 100 specifies a position within the passage area of the sheet S having the identified sheet size and the non-passage area of the sheet S having the sheet size smaller by one size than the identified sheet size among the three positions P1 to P3 determined in advance as the control positions of the main temperature sensor 46. Then, the control unit 100 moves the main temperature sensor 46 to the specified position by the sensor driving unit 49. The process of the present step SA2 corresponds to sensor position control.

In step SA3, the control unit 100 operates the main heater 44 and the sub-heater 45 at a lighting ratio corresponding to the sheet size identified in step SA1. The lighting ratio is set to 50:50 in the A4 size, 80:20 in the A5 size, and 100:0 in the A6 size as described above.

In step SA4, the control unit 100 controls the amount of power supplied to the main heater 44 and the sub-heater 45 such that the temperature detected by the main temperature sensor 46 reaches the target temperature determined in advance. The control of the power supply amount is performed by controlling a power supply circuit connected to a power source. The target temperature is an optimum temperature for melting the toner image and fixing the toner image to the sheet S, and is set to 180° C., for example. After the process of the present step SA4 is completed, the control unit 100 proceeds to return.

[Operation Effects]

The operation effects of the present embodiment will be described after mentioning the related problems.

In the related fixing device, unlike the aforementioned embodiment, the main temperature sensor is fixed at the axial center position of the fixing roller. Therefore, when a sheet size set by a user through the operation unit 1*a* is different from the sheet size of the sheet S to be actually printed (for example, when the user erroneously inputs the sheet size), there is a problem that the temperature of the non-passage area of the sheet S in the fixing roller 41 exceeds the threshold temperature (for example, 210° C.)

Figure 8:
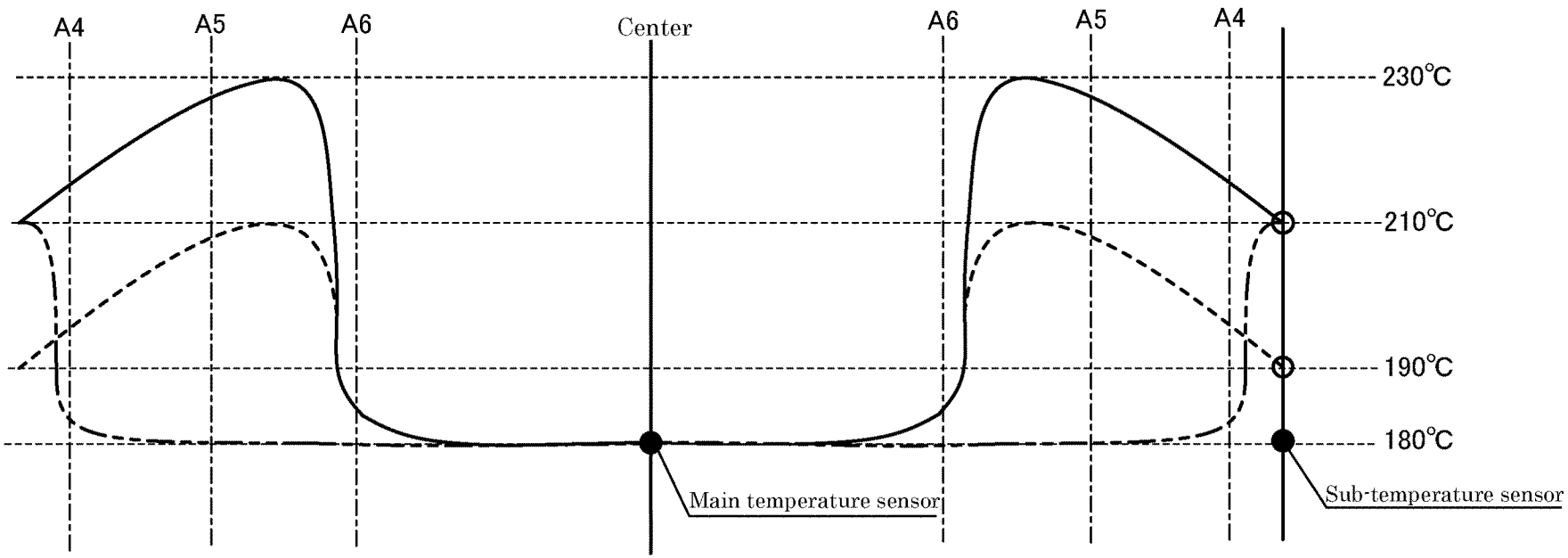
Fig.8 Prior Art
FIG. 8 is a graph for explaining a temperature distribution on a surface of a fixing roller when a sheet size set by an operation unit is an A4 size and a sheet size of a sheet to be actually printed is an A6 size in a fixing device of a related example.
Figure 9:
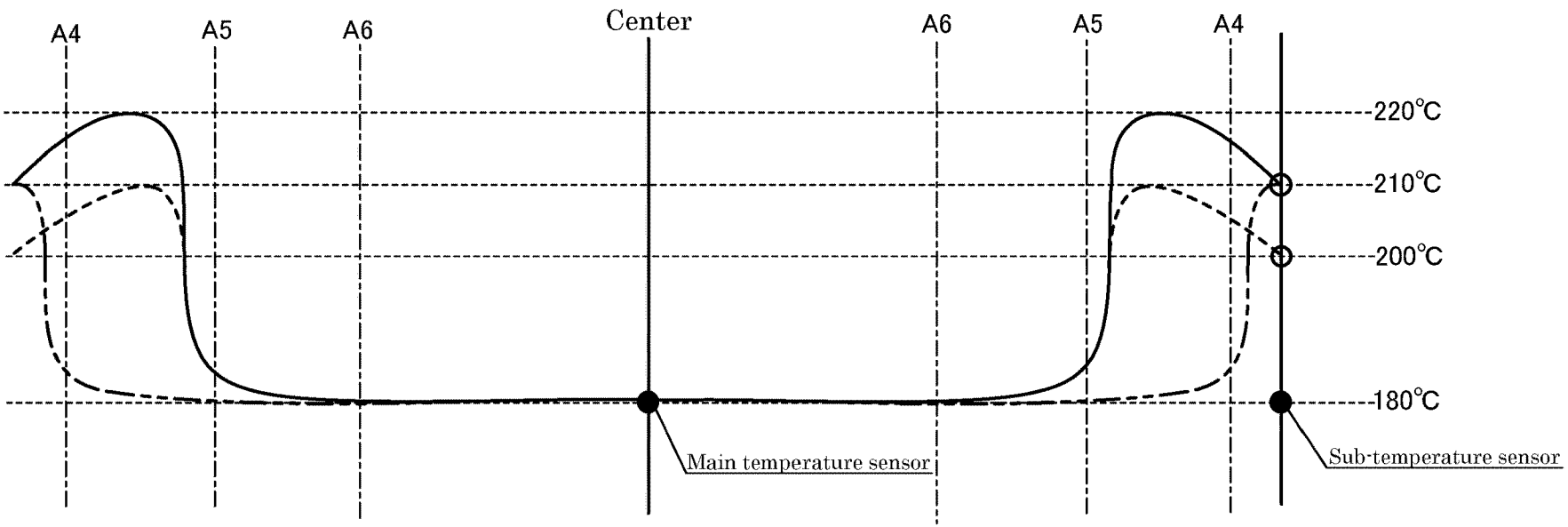
Fig.9 Prior Art
FIG. 9 is a graph for explaining a temperature distribution on a surface of a fixing roller when a sheet size set by an operation unit is an A4 size and a sheet size of a sheet to be actually printed is an A5 size in a fixing device of a related example.
Figure 10:
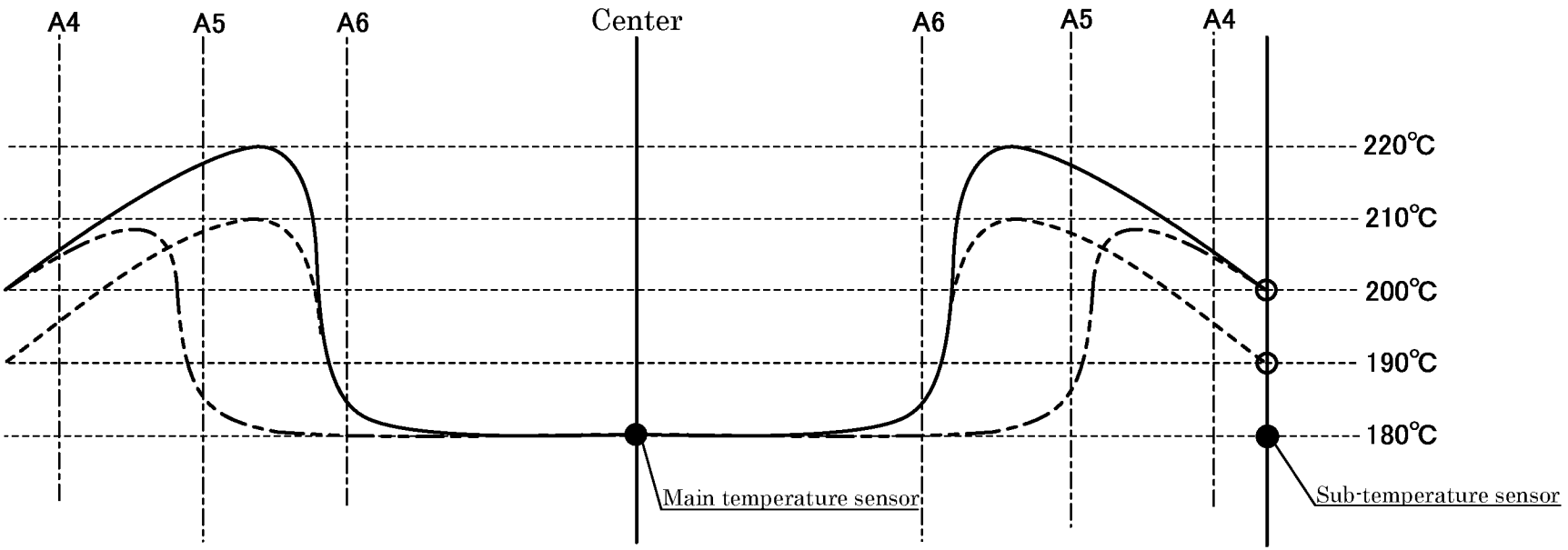
Fig.10 Prior Art
FIG. 10 is a graph for explaining a temperature distribution on a surface of a fixing roller when a sheet size set by an operation unit is an A5 size and a sheet size of a sheet to be actually printed is an A6 size in a fixing device of a related example.

FIG. 8 to FIG. 10 are graphs for explaining specific examples of the problem.

In the graph of FIG. 8, the solid line indicates a temperature distribution when a sheet size set by a user through the operation unit 1*a* is the A4 size but the sheet size of the sheet S to be actually subjected to the fixing process is the A6 size. It is noted that in FIG. 8, for reference, the broken line indicates a case where the sheet size set by the user and the sheet size to be actually subjected to the fixing process are the same (A6 size) and the two dot chain line indicates a case where the two sheet sizes are the same (A4 size).

When the sheet S to be subjected to the fixing process is the A6 size, the lighting ratio of the main heater 44 and the sub-heater 45 should be controlled to 100:0 as described above. However, the control unit 100 performs the operation control of each of the heaters 44 and 45 at the lighting ratio 50:50 corresponding to the A4 size erroneously set by the user through the operation unit 1*a*. As a consequence, the lighting ratio of the sub-heater 45 is higher than when heating ratio control corresponding to the A6 size is performed. Therefore, since the temperature of the non-passage area of the sheet S in the fixing roller 41 is excessively increased (increased by 20° C. from the target temperature in this example), the fixing roller 41 is thermally deteriorated.

Similarly, FIG. 9 will be described. In FIG. 9, the solid line indicates a temperature distribution when the sheet size set by the user through the operation unit 1*a* is the A4 size but the sheet size of the sheet S to be actually subjected to the fixing process is the A5 size. Also, in such a case, similarly to the case of FIG. 8 described above, since the temperature of the non-passage area of the sheet S in the fixing roller 41 is excessively increased (increased by 10° C. in this example), the fixing roller 41 is thermally deteriorated. It is noted that in FIG. 9, for reference, the broken line indicates a case where the sheet size set by the user and the sheet size to be actually subjected to the fixing process coincide with an A5 size and the two dot chain line indicates a case where the two sheet sizes coincide with an A4 size.

Similarly, FIG. 10 will be described. In FIG. 10, the solid line indicates a temperature distribution when the sheet size set by the user through the operation unit 1*a* is the A5 size but the sheet size of the sheet S to be actually subjected to the fixing process is the A6 size. Also in such a case, similarly to the case of FIG. 8 described above, since the temperature of the non-passage area of the sheet S in the fixing roller 41 is excessively increased (increased by 10° C. in this example), the fixing roller 41 is thermally deteriorated. It is noted that in FIG. 10, for reference, the broken line indicates a case where the sheet size set by the user and the sheet size to be actually subjected to the fixing process are the same (A6 size) and the two dot chain line indicates a case where the two sheet sizes are the same (A5 size).

In contrast to the related problems described in FIG. 8 to FIG. 10, in the present embodiment, the main temperature sensor 46 is allowed to be located within the passage area of the sheet S having the sheet size identified based on the information from the operation unit 1*a* and the non-passage area of the sheet having the sheet size smaller by one size than the sheet size.

According to this, when the sheet size set by the user through the operation unit 1*a* is smaller than the sheet size of the sheet to be actually subjected to the fixing process, the main temperature sensor 46 is located in the non-passage area of the sheet S to be actually subjected to the fixing process. Since the temperature in the non-passage area of the sheet S is higher than that in the passage area, the operation control of each heater is performed such that the temperature detected by the main temperature sensor 46 provided in the non-passage area reaches the target temperature, so that the aforementioned problem of excessive temperature rise does not occur in principle.

Figure 11:
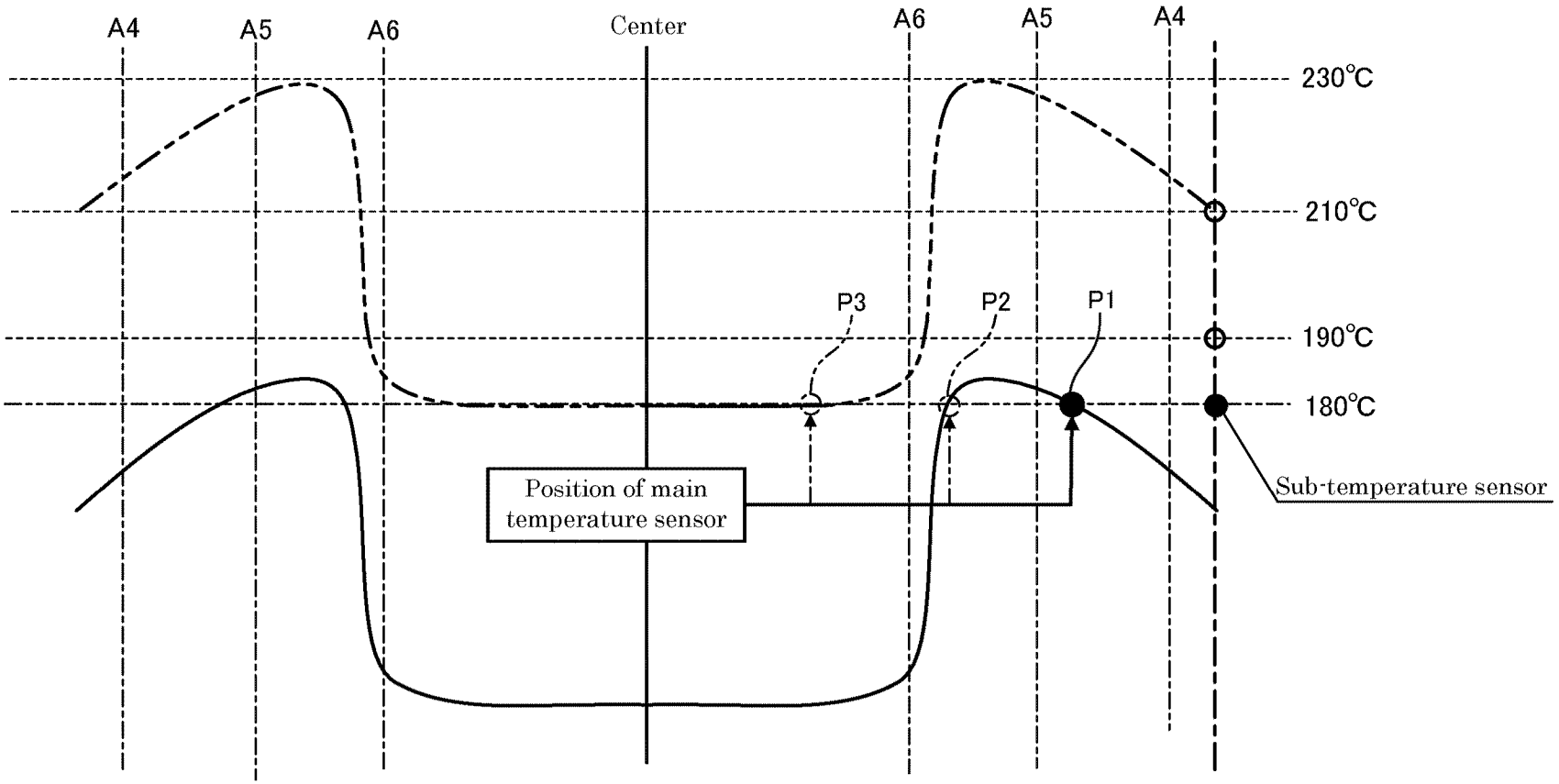
FIG. 11 is a diagram corresponding to FIG. 8 in a fixing device of the present embodiment.
Figure 12:
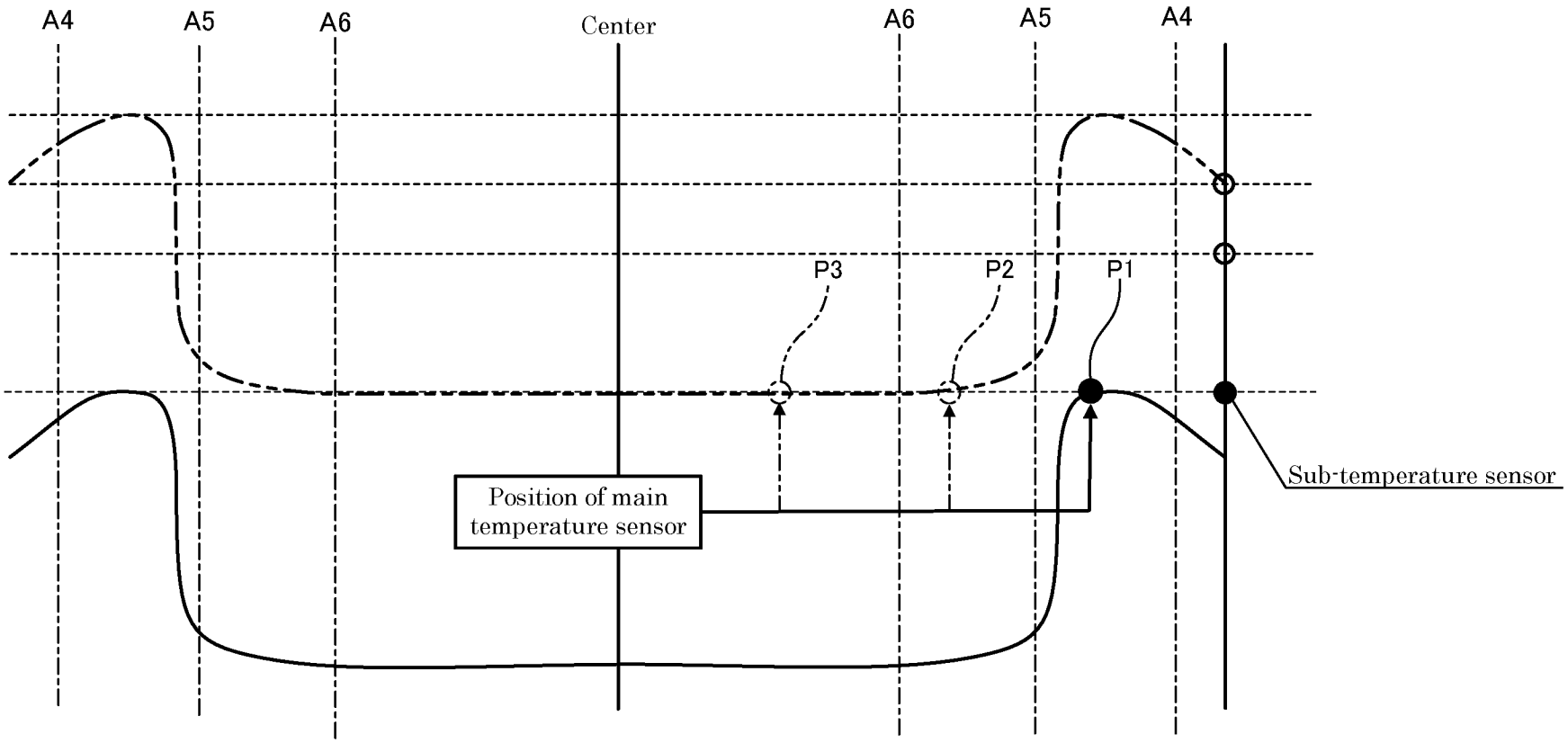
FIG. 12 is a diagram corresponding to FIG. 9 in a fixing device of the present embodiment.
Figure 13:
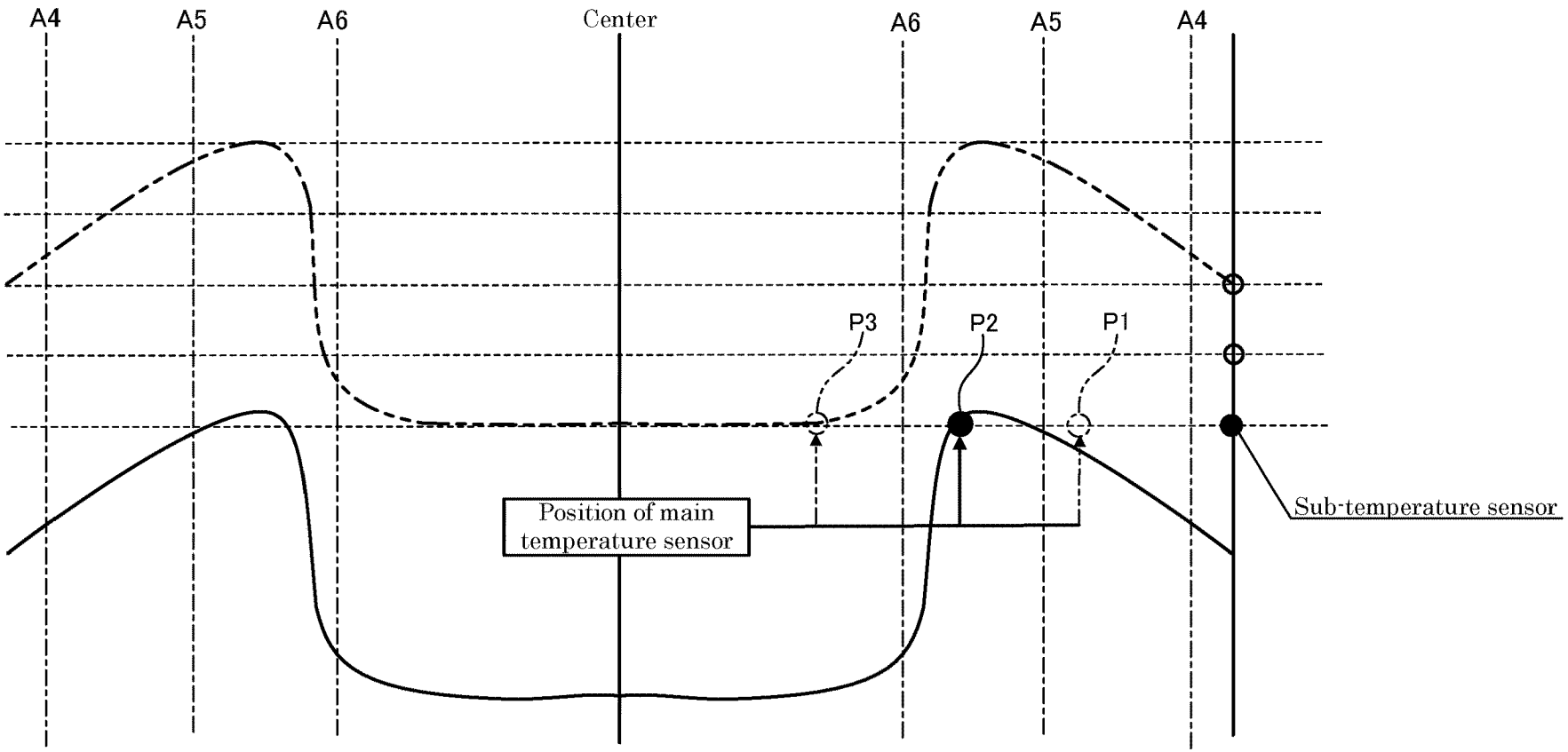
FIG. 13 is a diagram corresponding to FIG. 10 in a fixing device of the present embodiment.

With reference to FIG. 11 to FIG. 13, the operation effects will be described in more detail.

In FIG. 11, the solid line indicates a case where the sheet S having the A6 size is actually used in the fixing device 40 of the present embodiment even though the user sets the sheet size to the A4 size through the operation unit 1*a*. In such a case, since the sheet size of the sheet S to be subjected to the fixing process is the A6 size, the lighting ratio of the main heater 44 and the sub-heater 45 should be 100:0, the control unit 100 performs the operation control of each of the heaters 44 and 45 at the lighting ratio 50:50 corresponding to the A4 size. Therefore, since the lighting ratio of the sub-temperature sensor 47 is increased with respect to the sheet size (=A6) of the sheet S to be actually subjected to the fixing process, excessive temperature rise is likely to occur. However, as a result of the position control by the control unit 100, the main temperature sensor 46 is actually located at the position P1 within the non-passage area of the sheet S. Furthermore, the control unit 100 performs the operation control of each of the heaters 44 and 45 such that the temperature detected by the main temperature sensor 46 reaches the target temperature (=180° C.). As a consequence, the temperature distribution of the fixing roller is represented as a solid line, in which excessive temperature rise of the non-passage area (area outside the sheet S having the A6 size) of the sheet S is sufficiently suppressed, as indicated by the solid line of FIG. 11. It is noted that in FIG. 11, the two dot chain line indicates a case where the related fixing device in which the position of the main heater 44 is fixed at a center is used, and in the present embodiment (solid line), it can be seen that the surface temperature of the fixing roller 41 is reduced by 30° C. or more in the non-passage area of the sheet S as compared with the related example (two dot chain line).

Similarly, in FIG. 12, the solid line indicates a case where the sheet S having the A5 size is actually used in the fixing device 40 of the present embodiment even though the user sets the sheet size to the A4 size through the operation unit 1*a*. In FIG. 13, the solid line indicates a case where the sheet S having the A6 size is actually used even though the user sets the sheet size to the A5 size through the operation unit 1*a*. In any case, since the main temperature sensor 46 is actually located in the non-passage area of the sheet S, no excessive temperature rise occurs in the non-passage area unlike the related example indicated by the two dot chain line of each drawing.

As described above, in the present embodiment, when the sheet size manually set by the user is different from the sheet size of the sheet S to be actually used, it is possible to prevent the temperature of the non-passage area of the sheet in the fixing roller 41 from excessively rising. Consequently, it is possible to avoid a problem such as life reduction due to thermal deterioration of the fixing roller 41.

Embodiment 2

Figure 14:
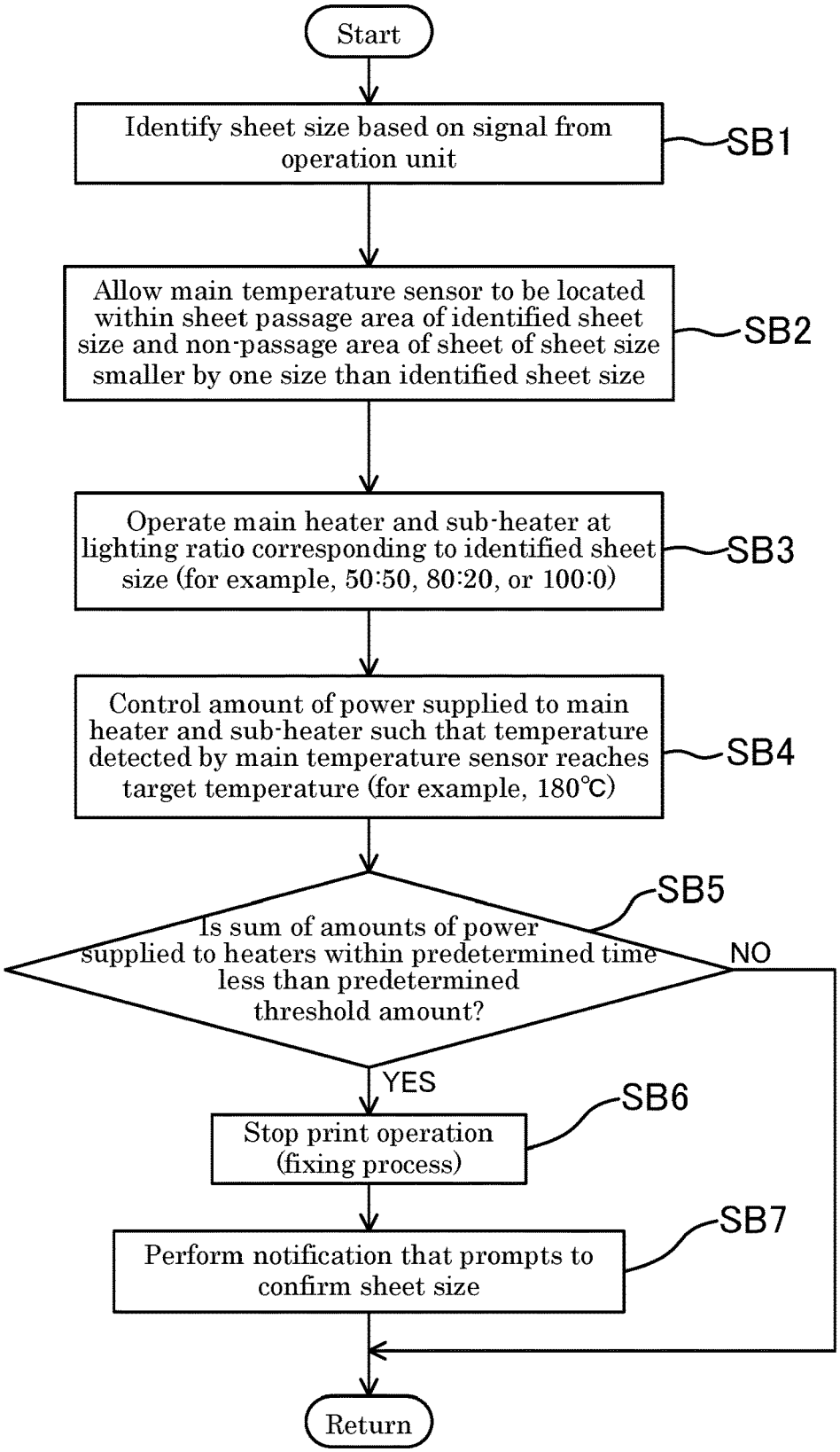
FIG. 14 is a diagram corresponding to FIG. 7, which illustrates an embodiment 2.

FIG. 14 is a flowchart illustrating the content of control performed by the control unit 100 of the embodiment 2.

Since the processes of step SB1 to step SB4 are the same as those of step SA1 to step SA4 of the embodiment 1, a description thereof will be omitted.

In step SB5, the control unit 100 determines whether the sum of the amounts of power supplied to the heaters 44 and 45 within a predetermined time is less than a predetermined threshold amount. The predetermined threshold amount is a lower limit value of the amount of power capable of fixing the toner image to the sheet S without causing fixing failure. It is sufficient if the predetermined time is set to a time of about 10 seconds to about 15 seconds, for example. When the determination of the present step SB5 is NO, the control unit 100 proceeds to return, and when the determination is YES, the control unit 100 proceeds to step SB6.

In step SB6, the control unit 100 stops the print operation of the entire image forming apparatus 1. Accordingly, the control unit 100 stops the fixing process of the fixing device 40.

In step SB7, the control unit 100 determines that the sheet size set by the user through the operation unit 1*a* is different from the sheet size of the sheet S to be actually used, and performs notification that prompts to confirm the sheet sizes. This notification may be performed by, for example, displaying a message on a display screen provided on the operation panel or may be performed by voice using a speaker and the like. In such a case, the operation panel or the speaker serves as a notification unit in cooperation with the control unit 100. After the process of step SB7, the control unit 100 proceeds to return.

[Operation Effects]

The operation effects of the present embodiment 2 will be described in comparison with the embodiment 1.

In the embodiment 1, when the sheet size set by the user is different from the sheet size of the sheet S to be actually used, the main temperature sensor 46 is located within the non-passage area (outside the passage area) of the sheet S. Therefore, since the temperature of the fixing roller 41 in the sheet passage area is lower than the target temperature 180° C. (see the solid lines of FIG. 11 to FIG. 13), fixing failure may occur.

Invertors and the like focuses on the fact that the amount of power supplied to each of the heaters 44 and 45 decreases in such a situation. The control unit determines that the sheet size set by the user through the operation unit 1*a* is different from the sheet size of the sheet S to be actually used when the sum of the amounts of power supplied to the heaters 44 and 45 is a predetermined threshold value or less, and temporarily stops a print operation. Then, the inventors and the like perform notification that prompts to confirm the sheet size manually set by the user. Consequently, it is possible to prevent a print operation from being continued in a state in which fixing failure has occurred.

Embodiment 3

Figure 15:
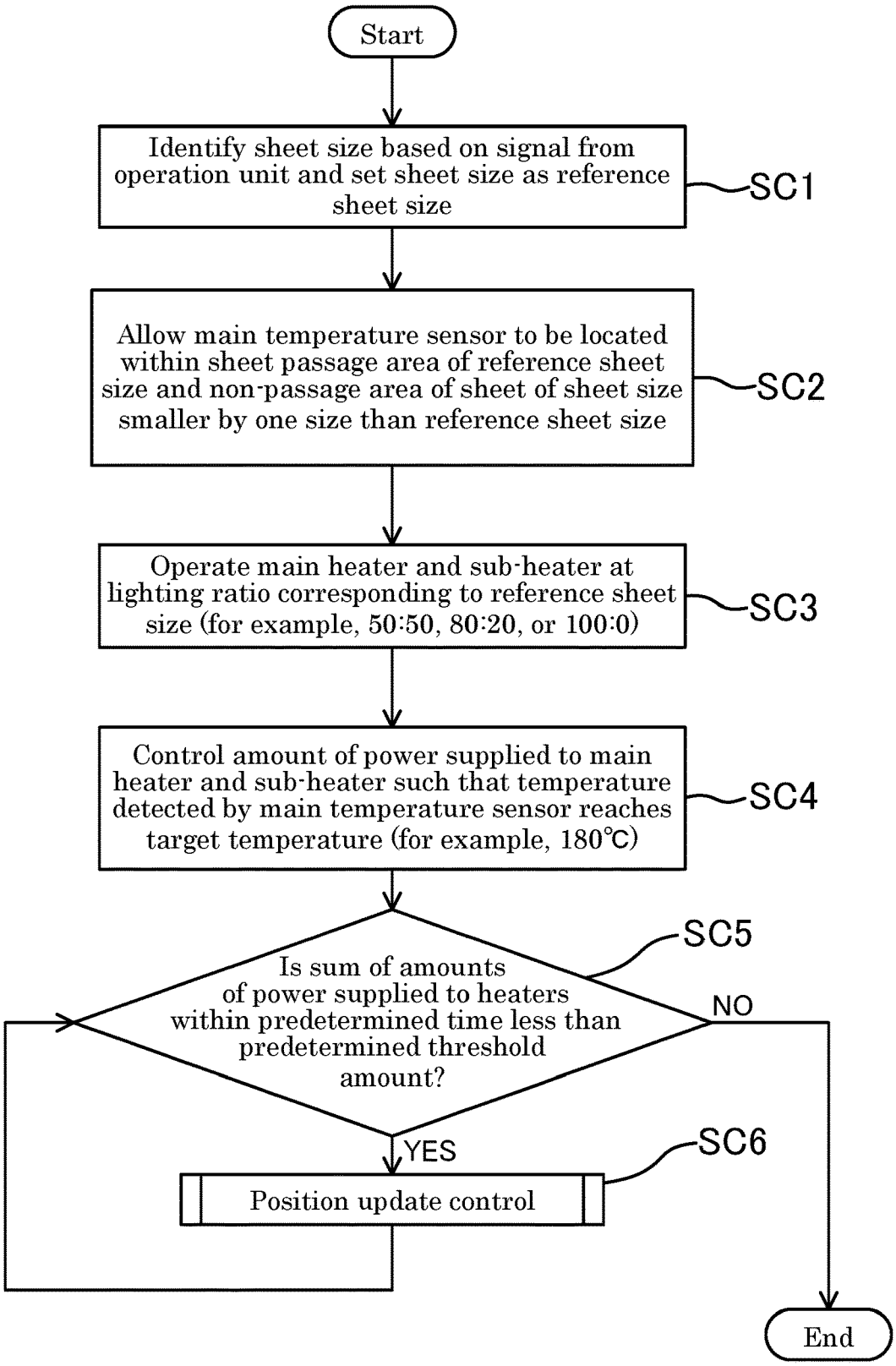
FIG. 15 is a diagram corresponding to FIG. 7, which illustrates an embodiment 3.
Figure 16:
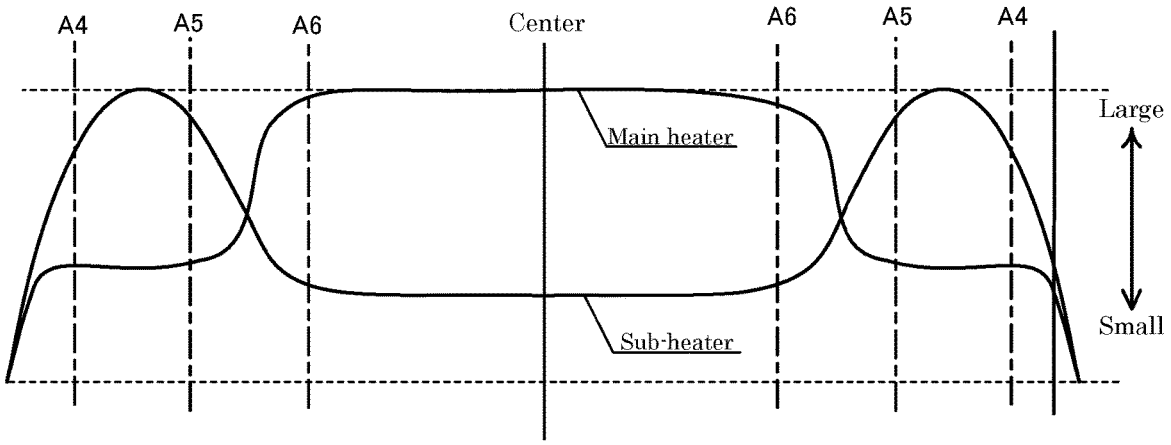
Fig.16 Prior Art
FIG. 16 is a diagram corresponding to FIG. 5, which illustrates a related example.
Figure 17:
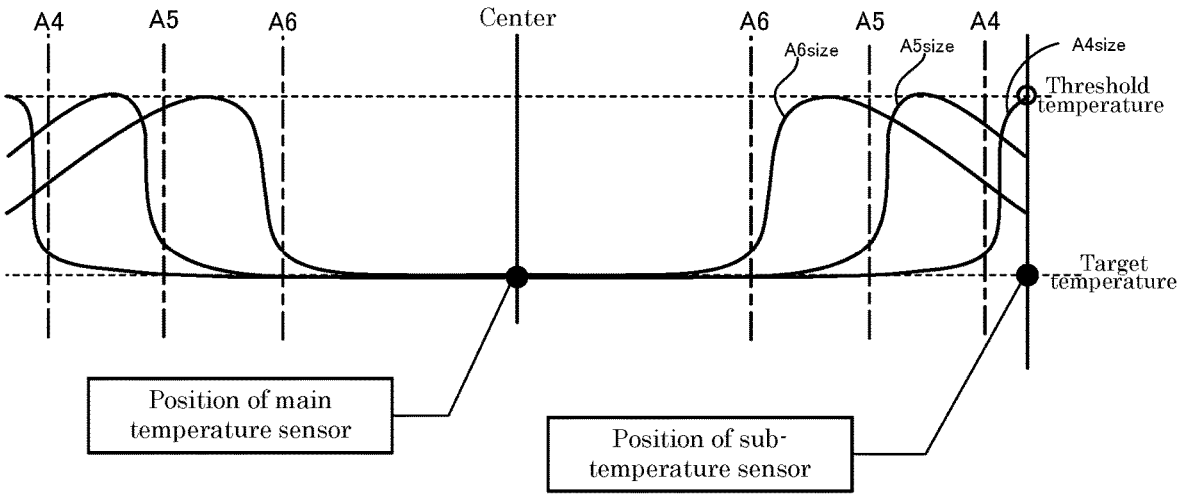
Fig.17 Prior Art
FIG. 17 is a diagram corresponding to FIG. 6, which illustrates a related example.

FIG. 15 is a flowchart illustrating the content of control performed by the control unit 100 of the embodiment 3.

The processes of steps SC1 to SC5 are similar to those of steps SB1 to SB5 of the embodiment 2. However, in steps SC1 to SC5, in order to perform position update control of step SC6, the sheet size identified based on the signal from the operation unit 1*a* is temporarily stored as a reference sheet size for the purpose of convenience.

In step SC6 that is performed when the determination of step SC5 is YES, the control unit 100 performs the position update control and then returns to step SC5. After the power supply amount in step SC5 is the predetermined threshold amount or more (after the determination of step SC5 is NO), the control unit 100 proceeds to end.

In the position update control, the reference sheet size is updated to a one size smaller sheet size, and the main temperature sensor 46 is moved in the passage area of the sheet S having the updated reference sheet size and the non-passage area of the sheet S having the sheet size smaller by one size than the reference sheet size.

[Operation Effects]

According to the position update control, in a case where the main temperature sensor 46 is located at the position P1 (for example, see FIG. 6), when the power supply amount is less than the predetermined threshold amount, the reference sheet size is updated from the A4 size to the A5 size and the position of the main temperature sensor 46 is moved (updated) from the position P1 to the position P2 by the sensor driving unit 49. Nevertheless, when the power supply amount is still less than the predetermined threshold amount, the reference sheet size is updated from the A5 size to the A6 size and the position of the main temperature sensor 46 is moved (updated) from the position P2 to the position P3 by the sensor driving unit 49.

According to this, it is possible to avoid the aforementioned problems of the excessive temperature rise and the fixing failure of the fixing roller 41 without making a user aware of setting mistake of a sheet size.

Other Embodiments

The technology of the present disclosure may also be configured as follows for the aforementioned each embodiment.

In the aforementioned each embodiment, the operation unit 1*a* is a touch panel or an operation button device provided on the operation panel; however, the technology of the present disclosure is not limited thereto. The operation unit 1*a* may also be, for example, a sheet width regulation cursor provided in a manual feed tray or the sheet feeding cassette 10*a*. The sheet width regulation cursor is slidable by manual operation and the cursor position is transmitted to the control unit 100 via a sensor.

In the aforementioned embodiments, a plurality of predetermined fixed sizes are three of the A4 size, the A5 size, and the A6 size; however, the technology of the present disclosure is not limited thereto and the fixed sizes may be two or four or more.

In the aforementioned each embodiment, the laser printer has been described as an example of the image forming apparatus 1 mounted with the fixing device 40; however, the technology of the present disclosure is not limited thereto and the image forming apparatus 1 may be a copy machine, a facsimile, a multifunctional peripheral (MFP) and the like.

In the aforementioned embodiments 2 and 3, it is determined whether the sum of the amounts of power supplied to the heaters 44 and 45 is less than the predetermined threshold amount; however, the technology of the present disclosure is not limited thereto and attention may be paid for example, only to the amount of power supplied to the main heater 44 (or the sub-heater 45).

What is claimed is:

1. A fixing device comprising:

a fixing rotating body;

a heating unit that heats the fixing rotating body;

a pressure rotating body that is brought into press-contact with the fixing rotating body to form a nip part through which a sheet passes;

a size identification unit that detects manual operation related to a sheet size of a sheet to be used and identifies the sheet size of the sheet to be used from a plurality of predetermined fixed sizes;

a temperature sensor that detects a temperature of a surface of the fixing rotating body;

a heating control unit that controls the heating unit such that the temperature detected by the temperature sensor reaches a target temperature and reduces a heating ratio on an end part side in an axial direction of the fixing rotating body by the heating unit as compared with a center side as the sheet size identified by the size identification unit is smaller;

a sensor driving unit that drives the temperature sensor to be movable in the axial direction of the fixing rotating body; and a sensor position control unit that controls a position of the temperature sensor by the sensor driving unit, wherein the sensor position control unit is configured to perform sensor position control for setting the sheet size identified by the size identification unit as a reference sheet size and allowing the temperature sensor to be located within a passage area of a sheet having the reference sheet size and a non-passage area of a sheet having a sheet size smaller by one size than the reference sheet size.

2. The fixing device of claim 1, further comprising:

a notification unit that determines whether an amount of power supplied to the heating unit within a predetermined time is less than a predetermined threshold amount after the sensor position control is performed by the sensor position control unit, stops a fixing process when the amount of the power supplied to the heating unit is determined to be less than the predetermined threshold amount, and performs notification that prompts to confirm a sheet size manually set by a user.

3. The fixing device of claim 1, wherein the heating unit is configured to heat the fixing rotating body at a temperature corresponding to a supplied power amount, and the sensor position control unit is configured to determine whether an amount of power supplied to the heating unit within a predetermined time is less than a predetermined threshold amount after the sensor position control is performed, and perform position update control for updating the reference sheet size to a one size smaller sheet size and moving the temperature sensor within a passage area of a sheet having the updated reference sheet size and a non-passage area of a sheet having the sheet size smaller by one size than the reference sheet size when the amount of the power supplied to the heating unit is less than the predetermined threshold amount.

4. An image forming apparatus comprising the fixing device of claim 1.

* * * * *